US008578532B2

(12) United States Patent
Ashrafzadeh et al.

(10) Patent No.: US 8,578,532 B2
(45) Date of Patent: Nov. 12, 2013

(54) LAUNDRY TREATING APPLIANCE WITH CONTROLLED MECHANICAL ENERGY

(75) Inventors: Farhad Ashrafzadeh, Stevensville, MI (US); Ryan R. Bellinger, Saint Joseph, MI (US); Duane M. Kobos, Laporte, IN (US); Richard A. Sunshine, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1144 days.

(21) Appl. No.: 12/507,286

(22) Filed: Jul. 22, 2009

(65) Prior Publication Data

US 2011/0016738 A1 Jan. 27, 2011

(51) Int. Cl.
*D06F 33/00* (2006.01)

(52) U.S. Cl.
USPC ..... 8/159; 8/158; 68/12.01; 68/12.02

(58) Field of Classification Search
USPC ..... 8/158, 159; 68/12.01, 12.02
See application file for complete search history.

(56) References Cited

U.S. PATENT DOCUMENTS

| | | | | |
|---|---|---|---|---|
| 3,923,889 | A | 12/1975 | Schmeidl et al. | |
| 4,489,455 | A * | 12/1984 | Spendel | 8/158 |
| 5,166,592 | A | 11/1992 | Bashark | |
| 6,581,230 | B2 | 6/2003 | Weinmann | |
| 6,671,915 | B2 | 1/2004 | Bringewatt et al. | |
| 2002/0029428 | A1 * | 3/2002 | Weinmann | 8/159 |
| 2004/0200008 | A1 | 10/2004 | Weinmann | |
| 2008/0115295 | A1 * | 5/2008 | Vadakkeveedu et al. | 8/159 |
| 2008/0157781 | A1 * | 7/2008 | Mason et al. | 324/536 |

FOREIGN PATENT DOCUMENTS

| | | | |
|---|---|---|---|
| DE | 3436786 | A1 | 4/1986 |
| DE | 19619603 | A1 | 11/1997 |
| DE | 19849403 | A1 | 5/2000 |
| DE | 10217009 | C1 | 10/2003 |
| DE | 10316879 | B3 | 12/2004 |
| DE | 102007057331 | A1 | 6/2009 |

OTHER PUBLICATIONS

German Search Report for DE102010016454, Feb. 6, 2012.

* cited by examiner

*Primary Examiner* — Michael Kornakov
*Assistant Examiner* — Marc Lorenz

(57) ABSTRACT

A laundry treating appliance and a method for operating a laundry treating appliance having a rotatable drum defining a chamber for receiving laundry. The operation of the laundry treating appliance may be based on the mechanical energy due to the falling action of the laundry.

32 Claims, 8 Drawing Sheets

LAUNDRY TREATING APPLIANCE WITH CONTROLLED MECHANICAL ENERGY

BACKGROUND OF THE INVENTION

A laundry treating appliance is a common household device for treating articles in accordance with a treating cycle, and includes clothes washing machines and clothes dryers. A clothes washing machine cleans loads of articles, such as clothing and other fabric items, in accordance with a preprogrammed wash cycle.

For automatic washers, there are three primary sources of cleaning action: mechanical action, chemical action, and thermal action. All other things being equal, any change in one or more of these actions requires a corresponding offsetting change in the other actions to obtain the same degree of cleaning effectiveness.

Automatic washing machines can generally be categorized as horizontal axis machines or vertical axis machines. Horizontal axis machines are sometimes referred to as "front loaders" and comprise a perforated drum located within an imperforate tub, with the drum rotating about a generally horizontal axis, although the axis can be canted relative to the horizontal.

Vertical axis and horizontal axis machines differ in the manner in which they impart mechanical energy to the laundry. Vertical axis machines tend to use an impeller or agitator that directly impacts the laundry to impart mechanical energy. Horizontal axis machines impart mechanical energy primarily by the tumbling of the articles in the drum as the drum rotates.

The different manners for imparting mechanical energy results in different operational consequences. One consequence is that horizontal axis machines impart much less mechanical energy to the laundry than vertical axis machines. Another of which is that it is practical to determine the amount of mechanical energy imparted in a vertical axis machine and impractical to determine in a horizontal axis machine. The direct contact of the impeller/agitator to the laundry to impart the mechanical energy in a vertical axis machine as compared to the tumbling of the laundry in a horizontal axis machines provides for direct sensing through the forces of the impeller/agitator as a means for determining the imparted mechanical action forces, which is not possible with the horizontal axis machines.

SUMMARY OF THE INVENTION

The invention relates to a laundry treating appliance and a method of operating a laundry treating appliance based on the mechanical energy due to the falling action of the laundry.

DESCRIPTION OF AN EMBODIMENT OF THE INVENTION

Figure 1:
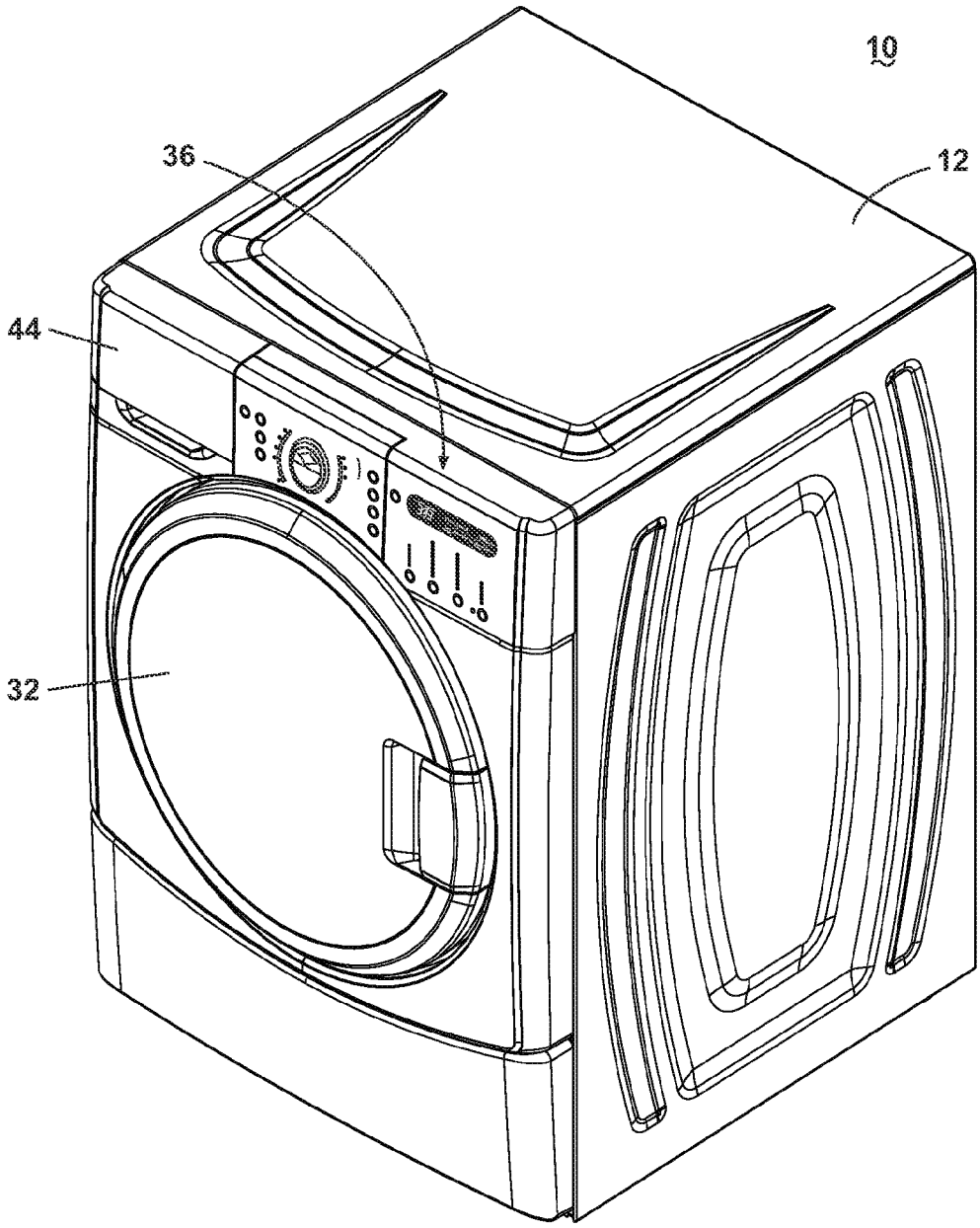
FIG. 1 is a perspective view of an exemplary laundry treating appliance in the form of a washing machine according to one embodiment.

Referring now to the figures, FIG. 1 is a perspective view of an exemplary laundry treating appliance in the form of a washing machine 10 according to one embodiment of the invention. The methods described herein may be used with any suitable laundry treating appliance and are not limited to use with washing machines, including the washing machine 10 described below and shown in the drawings. The washing machine 10 is described and shown for illustrative purposes. The laundry treating appliance may be any machine that treats articles such as clothing or fabrics, and examples of the laundry treating appliance may include, but are not limited to, a washing machine, including top-loading, front-loading, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the method will be described with respect to a washing machine with one or more articles making up the load, with it being understood that the invention may be adapted for use with other types of laundry treating appliances.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination.

Vertical axis and horizontal axis machines can be differentiated by the manner in which they impart mechanical energy to the load. In vertical axis machines, an article moving element moves within the drum to impart mechanical energy directly to the load or indirectly through wash liquid in the drum. In horizontal axis machines, mechanical energy is typically imparted to the load by tumbling the load resulting from rotating the drum. The tumbling involves repeated lifting and dropping of the articles in the load. The illustrated washing machine 10 of FIGS. 1 and 2 is a horizontal axis washing machine.

Figure 2:
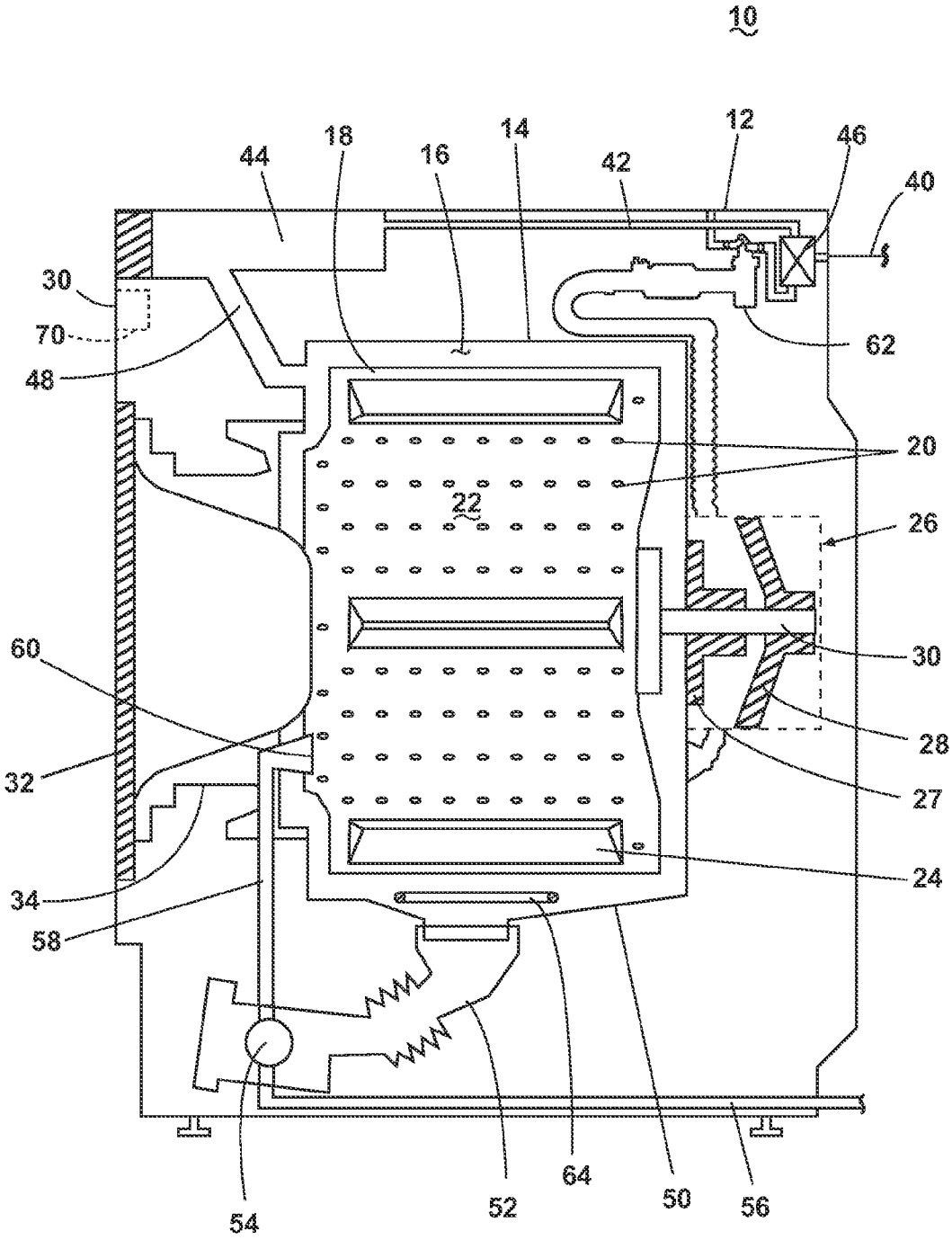
FIG. 2 is a schematic view of the washing machine of FIG. 1 according to one embodiment.

FIG. 2 provides a schematic view of the washing machine 10 of FIG. 1. The washing machine 10 may include a cabinet 12 that houses a stationary tub 14, which defines an interior chamber 16. A rotatable drum 18 may be mounted within the interior chamber 16 of the tub 14 and may include a plurality of perforations 20, such that liquid may flow between the tub 14 and the drum 18 through the perforations 20. The drum 18 defines a laundry treatment chamber 22 sized to hold a load, which may have one article or a plurality of articles. The drum 18 may further include a plurality of baffles 24 disposed on an inner surface of the drum 18 to lift the load contained in the laundry treatment chamber 22 while the drum 18 rotates. Depending on the various characteristics of the washing machine 10, such as the size of the drum 18 and the size of the load, the rotation of the drum 18 may result in various types of load movement inside the drum 18. For example, the load may undergo at least one of tumbling, rolling (also called balling), sliding, satellizing (also called plastering), and combinations thereof. The terms tumbling, rolling, sliding and satellizing are terms of art that may be used to describe the motion of some or all of the articles. However, not all of the articles forming the load must exhibit the motion for the load to be described accordingly.

The drum 18 may be coupled with a motor 26 having a stator 27 and a rotor 28 through a drive shaft 30 for selective rotation of the treating chamber 22 during a cycle of operation. The motor 26 may rotate the drum 18 at various speeds in either rotational direction. Both the tub 14 and the drum 18 may be selectively closed by a door 32. A bellows 34 couples an open face of the tub 14 with the cabinet 12, and the door 32 seals against the bellows 34 when the door 32 closes the tub 14.

A controller 70 may be coupled with various working components of the washing machine 10 to control the operation of the washing machine 10. The controller 70 can be operably coupled to a control panel 36 with a user interface provided on the exterior of the cabinet 12 that may include one or more knobs, switches, displays, and the like for communicating with the user, such as to receive input and provide output.

While the illustrated washing machine 10 includes both the tub 14 and the drum 18, with the drum 18 defining the laundry treatment chamber 22, it is within the scope of the invention for the laundry treating appliance to include only one receptacle, with the receptacle defining the laundry treatment chamber for receiving the load to be treated.

The washing machine 10 of FIG. 2 may further include a liquid supply and recirculation system. Liquid, such as water, may be supplied to the washing machine 10 from a water supply 40, such as a household water supply. A supply conduit 42 may fluidly couple the water supply 40 to a detergent dispenser 44. An inlet valve 46 may control flow of the liquid from the water supply 40 and through the supply conduit 42 to the detergent dispenser 44. A liquid conduit 48 may fluidly couple the detergent dispenser 44 with the tub 14. The liquid conduit 48 may couple with the tub 14 at any suitable location on the tub 14 and is shown as being coupled to a front wall of the tub 14 in FIG. 2 for exemplary purposes. The liquid that flows from the detergent dispenser 44 through the liquid conduit 48 to the tub 14 typically enters a space between the tub 14 and the drum 18 and may flow by gravity to a sump 50 formed in part by a lower portion of the tub 14. The sump 50 may also be formed by a sump conduit 52 that may fluidly couple the lower portion of the tub 14 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 18 in any suitable manner, such as by spraying, dripping, or providing a steady flow of the liquid.

The liquid supply and recirculation system may further include one or more devices for heating the liquid such as a steam generator 62 and/or a sump heater 64. The steam generator 62 may be provided to supply steam to the treating chamber 22, either directly into the drum 18 or indirectly through the tub 14 as illustrated. The valve 46 may also be used to control the supply of water to the steam generator 62. The steam generator 62 is illustrated as a flow through steam generator, but may be other types, including a tank type steam generator. Alternatively, the heating element 64 may be used to generate steam in place of or in addition to the steam generator 62. The steam generator 62 may be controlled by the controller 70 and may be used to heat to the load as part of a treating cycle, much in the same manner as heating element 64. The steam generator 62 may also be used to introduce steam to treat the load as compared to merely heating the load.

Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

Figure 3:
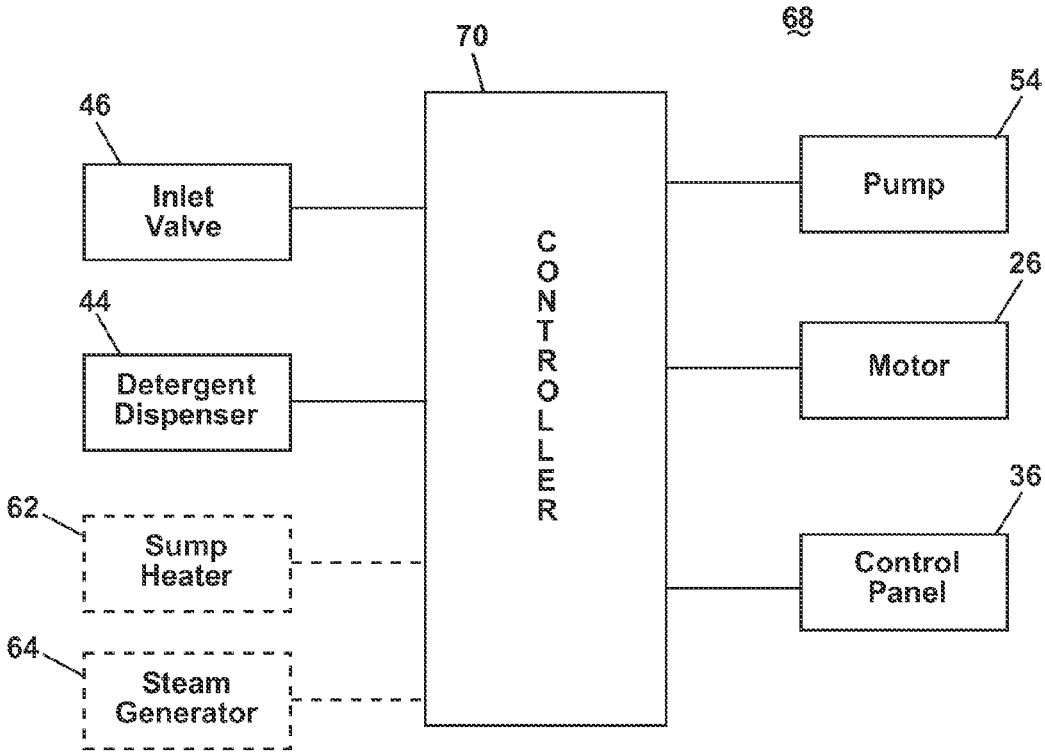
FIG. 3 is a schematic view of a control system according to one embodiment for the washing machine of FIGS. 1 and 2.

Referring now to FIG. 3, which is a schematic view of an exemplary control system 68 of the washing machine 10, the controller 70 may be coupled to various working components of the washing machine 10, such as the pump 54, the motor 26, the inlet valve 46, and the detergent dispenser 44, to control the operation of the washing machine 10. The controller 70 may further be coupled to the steam generator 62 and/or a sump heater 64 if either is provided. The controller 70 may receive data from one or more of the working components and may provide commands, which can be based on the received data, to one or more of the working components to execute a desired operation of the washing machine 10. The commands may be data and/or an electrical signal without data. The control panel 36 may be coupled to the controller 70 and may provide for input/output to/from the controller 70. In other words, the control panel 36 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

The washing machine 10 may perform one or more manual or automatic treating cycles, and a common treating cycle includes a wash phase, a rinse phase, and a spin extraction phase. Other phases for treating cycles include, but are not limited to, intermediate extraction phases, such as between the wash and rinse phases, and a pre-wash phase preceding the wash phase, and some treating cycles include only a select one or more of these exemplary phases. In a horizontal axis washing machine, the drum may be rotated during any one of these phases to effect tumbling of the articles making up the load. In particular tumbling may be combined with a wash phase to create a tumble wash phase. Regardless of the phases employed in the treating cycle, the methods described below may relate to determining an optimized rotational speed.

Figure 4:
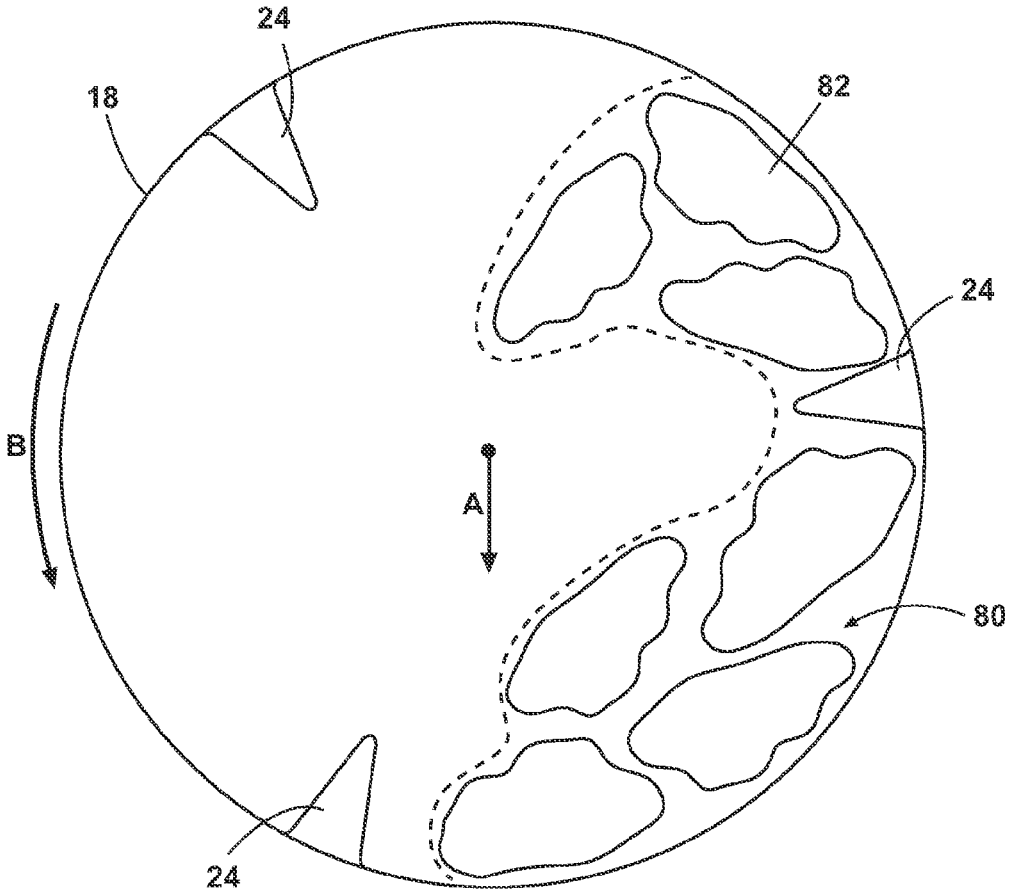
FIG. 4 is a schematic view of a drum of the washing machine from FIG. 1 and a load inside the drum according to one embodiment.

Before specific embodiments of the methods are presented, a description of theory behind the methods may be constructive. In a washing machine, the articles making up the load are cleaned by three main sources of energy: chemical, thermal, and mechanical. Referring to FIG. 4, which is a schematic view of the drum 18 and a load 80 in the drum 18, mechanical energy can further be divided into two components: article-to-article friction and the falling associated with the tumbling of articles due to the rotation of the drum 18, which is a greater source of mechanical energy than the article-to-article friction. During tumbling, articles 82 making up the load 80 rotate with the drum 18 from a lower position, generally near or at the bottom of the drum 18, to a raised position above the lower position, where the article is no longer being lifted by the drum 18 and falls within the drum 18, generally toward the bottom of the drum 18. The rotation of the articles with the drum 18 may be facilitated by the baffles 24. The point at where the article separates from the drum 18 and falls by gravity, illustrated by arrow A, to the nadir of the drum 18 is the function of several parameters, including, without limitation, the centrifugal force acting on the article, which varies with speed of rotation, illustrated by arrow B. During tumbling, the individual articles 82 may move relative to one another such that the articles may rub against each other and may fall onto each other as they fall to the lower position of the drum 18. This accounts for creating article-to-article friction.

The tumbling motion of the articles 82 is irregular. For example, some articles 82 may fall during one rotation of the drum 18 and not the next due to tangling or twisting of the articles 82. Each lifting/falling action changes the load on the motor 26 (FIG. 2), and thus creates a change in the motor torque, which can be seen in a motor torque signature. The change in motor torque is related to the dynamic change in the mass of the laundry that the motor must rotate. As each article is lifted, the motor torque is affected by the article's mass. However, when each article falls, the article has separated from the drum and the article's mass is temporarily not "seen" by the motor and the motor torque is not impacted by the falling article. Of course, the actual movement of a laundry load comprising multiple articles is more complex than the description of a single article because the interaction of the multiple laundry articles may interfere with a complete separation of a particular article.

One challenge in using the motor torque signature to identify falling action is that a load imbalance will also create a variation in the motor torque signature. Thus, it is necessary to distinguish motor torque variations caused by falling action, and those attributable to load imbalance. Distinguishing between load imbalance and falling action becomes more difficult for larger loads, since there may be little or no falling action because the drum 18 is more packed.

Figure 5A:
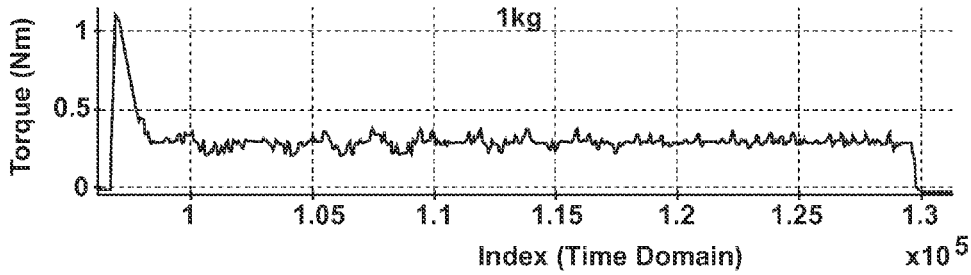
FIGS. 5A-5C show graphs of the motor torque signature during tumbling in a horizontal-axis washing machine, wherein the motor torque is shown in a time domain for loads of polyester cloth having a dry mass of about 1 kg, 3 kg, and 5 kg, respectively.
Figure 5B:
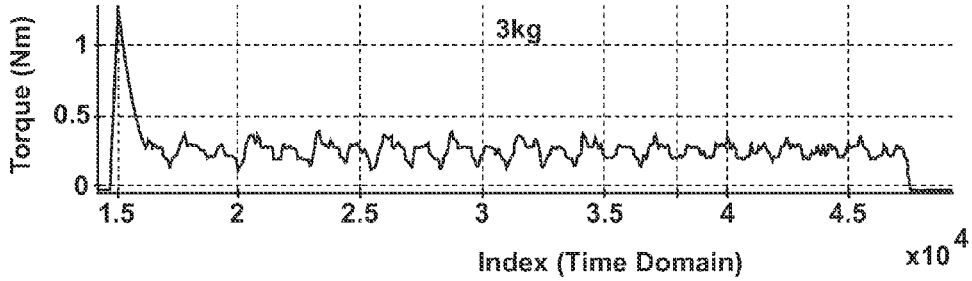
Figure 5C:
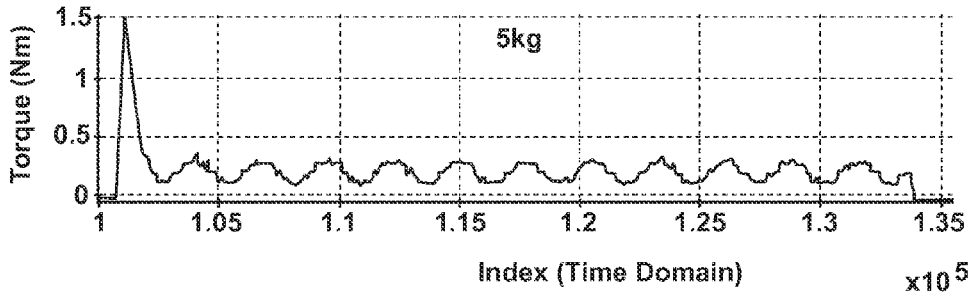

It has been found that a more sinusoidal motor torque signature indicates a load imbalance, rather than falling action, which is non-sinusoidal. FIGS. 5A-5C show exemplary experimental data of the motor torque as a function of time (i.e., in the time domain) for 1 kg, 3 kg, and 5 kg dry mass loads of polyester cloth during tumbling in a horizontal-axis washing machine, respectively. In the graphs, the time axis (i.e., the x-axis) is provided as an "Index" rather than "Time" due to the manner of recording experimental data. In the graphs, after an initial maximum peak at the initial start-up, the motor torque signature settles into a varying pattern containing peaks and valleys. The motor torque signature varies depending on whether there is a falling action, and also whether there is a load imbalance. For the exemplary 5 kg load, which has a more sinusoidal motor torque signature than the 1 kg or 3 kg loads, there is no falling action, but there is a load imbalance. Thus, the waveform of the motor torque signature can be used to distinguish between load imbalance and falling action.

One way to distinguish between sinusoidal and non-sinusoidal waveforms is by determining the crest factor of the waveform. The crest factor, or peak-to-average ratio (PAR), is a measurement of a waveform, calculated from the peak amplitude of the waveform divided by the RMS (time-averaged) value of the waveform, and can be expressed by the following equation:

$$C = \frac{|x|_{peak}}{x_{RMS}}$$

The crest factor is minimum for a sinusoidal wavefrom, and increases as a waveform becomes more non-sinusoidal; thus, a larger crest factor indicates that there is falling action of the articles and the relative magnitude of the crest factor is indicative of the relative amount of falling action.

The method of the invention can use the crest factor of the motor torque signature to distinguish between load imbalance and falling action. If the crest factor indicates that there is falling action, then the motor torque signature can be used to determine the degree of mechanical falling action being transferred to the articles in the drum. This can be estimated or inferred from the area underneath the motor torque signature waveform. The area can be viewed as a measurement system for the mechanical energy due to falling action imparted to the articles.

This measurement system can be used to control the rotational speed of the drum to control the amount of mechanical energy imparted by falling action to the laundry. For example, if it is desired to maximize the amount of mechanical energy, the rotational speed can be varied, e.g. increased or decreased, until the crest factor has been maximized. When the crest factor is maximized, the mechanical energy due to falling action being imparted to the articles is also maximized. Maximizing the mechanical energy may be useful to shorten the cycle time or when the laundry is of a more robust material. However, the amount of mechanical energy may be controlled to ensure lesser amounts of mechanical energy are imparted to the laundry, such as when the laundry is of a more delicate fabric.

This measurement system can also be used to determine when to terminate the treating cycle. For example, the mechanical energy due to falling action can be measured over time and, when the accumulated mechanical energy (area under the motor torque signature waveform) due to falling action has reached a predetermined value, a phase of the treating cycle or the entire treating cycle can be terminated. The predetermined value may be the minimum amount of mechanical energy due to falling action that sufficiently cleans the articles. Thus, this method optimizes the treating cycle to achieve a good cleaning performance while minimizing wear on the articles. Each treating cycle or each treating cycle phase may be provided with a predetermined mechanical energy that, when satisfied, may be used alone or in combination with other parameters to terminate the treating cycle or treating cycle phase.

Figure 6:
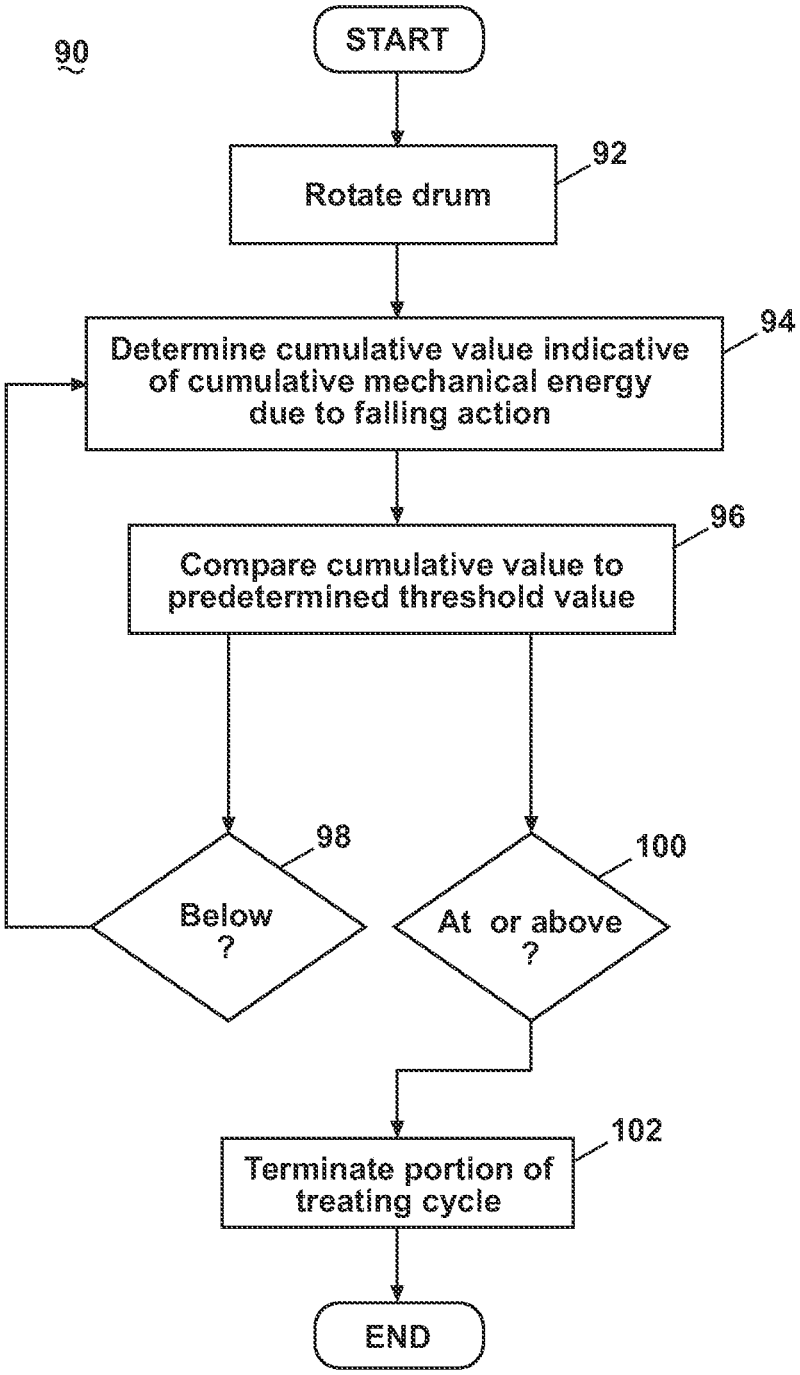
FIG. 6 is a flow chart illustrating one embodiment of a method according to the invention for determining when to terminate a portion of a treating cycle in a washing machine.

FIG. 6 provides a flow chart of an embodiment of a method 90 that employs the above theory to determine when to terminate a portion of a treating cycle in a washing machine. The sequence of steps depicted is for illustrative purposes only and is not meant to limit the method 90 in any way as it is understood that the steps may proceed in a different logical order, additional or intervening steps may be included, or described steps may be divided into multiple steps, without detracting from the invention. The method 90 may be incorporated into a treating cycle of the washing machine 10, such as during a specific treating phase, for example a wash phase or a tumble wash phase, or may be performed independently from a treating cycle. It is assumed that a load of one or more articles has been placed within the drum 18 prior to commencement of the method 90.

The method 90 may begin with at 92 with rotating the drum 18. Rotating of the drum 18 may occur subsequent to or simultaneously with wetting of the load by the liquid supply and recirculation system (FIG. 2). In the washing machine 10 of FIG. 2, the motor 26 may drive the rotation of the drum 18. The drum 18 may rotate at a speed suitable to induce tumbling of the load.

At 94, a determination of a cumulative value indicative of cumulative mechanical energy due to falling action may occur subsequent to or simultaneously with the rotating of the drum 18 by the motor 26 at 92. The cumulative value can be determined by determining a crest factor of a motor torque waveform for the motor 26 rotating the drum 18. As discussed above, this helps distinguish between falling action and a load imbalance. If the crest factor indicates that there is falling action of the articles, then the area beneath the motor torque waveform for the motor 26 can be used to determine the degree of mechanical falling action being transferred to the articles in the drum. This area or the degree of mechanical falling action determined from the area can be accumulated or summed over time to determine the cumulative value. The determination of the cumulative value can be carried out by the controller 70.

At 96, the cumulative value determined at 94 is compared with a predetermined threshold value. The threshold value is a reference value to compare with the cumulative value to determine whether to terminate at least a portion of the treating cycle. The threshold value may be a desired value of mechanical energy to impart to the laundry during the treating cycle.

The threshold value may be a function of at least one a laundry type and a load size, either of which can be a quantitative or qualitative value. One example of quantitative laundry type is the article's material, such as cotton, silk, or polyester. Examples of qualitative laundry type are delicates, permanent press, or heavy duty. Examples of quantitative load sizes are the mass, volume, or surface area of the load, or the number of articles making up the load. Examples of qualitative load sizes are extra-small, small, medium, large, or extra-large.

The threshold value may be predetermined, or may be determined for each load or treating cycle. For the later case, the threshold value may be automatically determined for the load, or may be manually set by the user. For the former case, the controller 70 may be loaded with one or more predetermined threshold values during manufacture.

The comparison may be carried out by the controller 70 and may be based on a predetermined relationship between the cumulative value and the threshold value. Based on the comparison, the method 90 may return to 94 to determine the cumulative value again, or may terminate at least a portion of the treating cycle. One example of a predetermined relationship is illustrated at 98 and 100. If it is determined that the cumulative value is below the threshold value, as shown at 98, the method 90 returns to 94. If it is determined that the cumulative value is at or above the threshold value, as shown at 100, the method 90 continues to 102, and at least a portion of the treating cycle is terminated.

Termination of at least a portion of the treating cycle may entail terminating a treating phase of the treating cycle, such as a tumble wash phase, or may entail terminating the treating cycle entirely. Termination of at least a portion of the treating cycle may alternately entail setting the duration of a treating phase or the treating cycle.

While not illustrated as part of the method 90, the cumulative value determined at 94 may be used to determine an operating rotational speed of the drum 18. If the cumulative value is determined from the crest factor, the rotational speed can be varied until the crest factor has been maximized, at which speed substantially maximum mechanical energy is imparted to articles in the load. The crest factor can also be determined for rotational speeds other than the maximum mechanical energy. It is contemplated to select a rotation speed less than, such as a percentage of, the rotational speed associated with the maximum crest factor. It is also contemplated to create a crest factor versus rotational speed profile for a given laundry load and to select the most advantageous rotational speed for a given load based on the profile.

It should be noted that while this description is written in absolute terms, such as determining the maximum crest factor, in practice, it is likely and often unnecessary to determine the absolute value of any parameter or value described. For example, it is contemplated that digital sampling techniques will be used, which may well miss the absolute maximum crest factor. However, the maximum crest factor as determined under such techniques will be close enough for a practical application of the invention.

Figure 7:
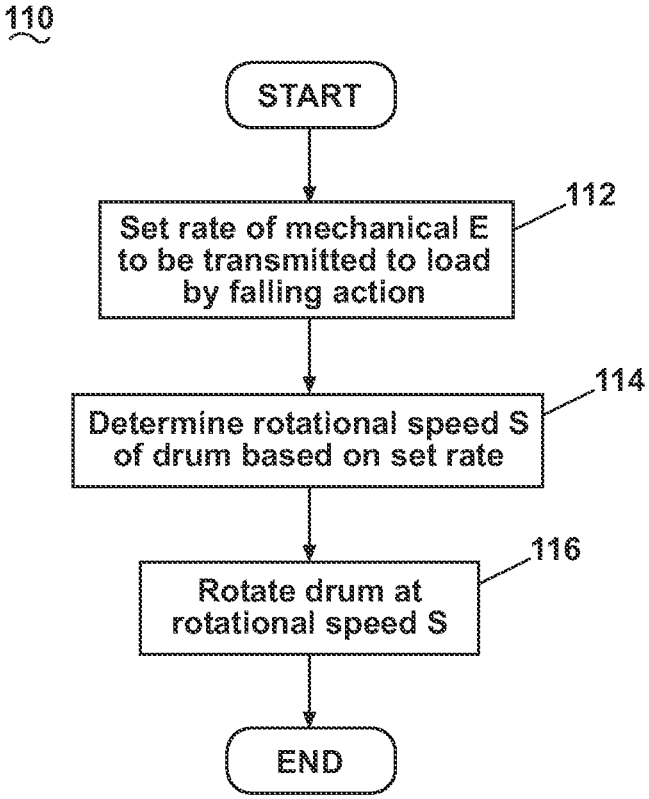
FIG. 7 is a flow chart illustrating one embodiment of a method according to the invention for determining a rotational speed of a drum of a washing machine that will cause a desired amount of mechanical energy to be transmitted to a load by falling action.

FIG. 7 provides a flow chart of an embodiment of a method 110 that employs the above theory to determine a rotational speed of the drum 18 that will cause a desired amount of mechanical energy to be transmitted to a load by falling action. The sequence of steps depicted is for illustrative purposes only and is not meant to limit the method 110 in any way as it is understood that the steps may proceed in a different logical order, additional or intervening steps may be included, or described steps may be divided into multiple steps, without detracting from the invention. The method 110 may be incorporated into a treating cycle of the washing machine 10 or may be performed independently from a treating cycle. It is assumed that a load of one or more articles has been placed within the drum 18 prior to commencement of the method 110.

The method 110 may begin at 112 by setting a rate of mechanical energy due to be transmitted to the load by falling action. The rate may be set by the user through the one or more user inputs using the user interface 36, such as by the selection of a treating cycle. From the user input, the rate may be automatically determined by the controller 70. The controller 70 may store different rates associated with particular treating cycles or a particular combination of user inputs, or may have a scheme for calculating the rate from the user input. The rate may be a function of at least one a laundry type and a load size, either of which can be a quantitative or qualitative value as described above. For example, if the user selects a 'delicate' treating cycle, the rate may be lower than if the user selected a 'heavy duty' treating cycle, since 'delicate' article are more subject to wear than 'heavy duty' articles.

The rate can be one that substantially maximizes the mechanical energy transmitted to the articles, such as through falling action of the articles as the drum 18 is rotated. By maximizing mechanical energy, the duration of the treating cycle or a portion of the treating cycle may be reduced since articles may be cleaned in less time.

At 114, a rotational speed S for the drum 18 is determined based on the rate set at 112. The rotational speed S may be a speed suitable to induce tumbling of the load wherein the load is subject to falling action. The rotational speed S can be determined by determining a crest factor of a motor torque waveform for the motor 26 rotating the drum 18. By increasing or decreasing the rotational speed of the drum 18 until the crest factor is maximized, the mechanical energy due to falling action being imparted to the articles is also maximized. Thus, the rotational speed when the crest factor is maximized can be considered a maximum mechanical energy rotational speed.

At 116, the drum 18 is rotated at the rotational speed S determined at 114. Rotation of the drum 18 may occur subsequent to or simultaneously with wetting of the load by the liquid supply and recirculation system (not shown). Rotation of the drum 18 may occur subsequent to or simultaneously with a particular treating phase of a treating cycle, such as a tumble wash phase.

In the washing machine 10 of FIG. 2, the controller 70 may control the motor 26 to drive the rotation of the drum 18 at the rotational speed S. According to one embodiment, the motor 26 rotates the drum 18 at a steady state for at least part of the determination at 114. For example, the rotational speed S may be a constant speed setpoint, wherein the motor 26 is controlled to rotate the drum 18 according to the setpoint, while the actual speed of the drum 18 fluctuates about the setpoint due to the rotation of the load in the drum 18 and imbalance in the load. It is also understood that the drum 18 may initiate rotation prior to 116, although it is also possible for the drum 18 to commence rotation only at 116.

Figure 8:
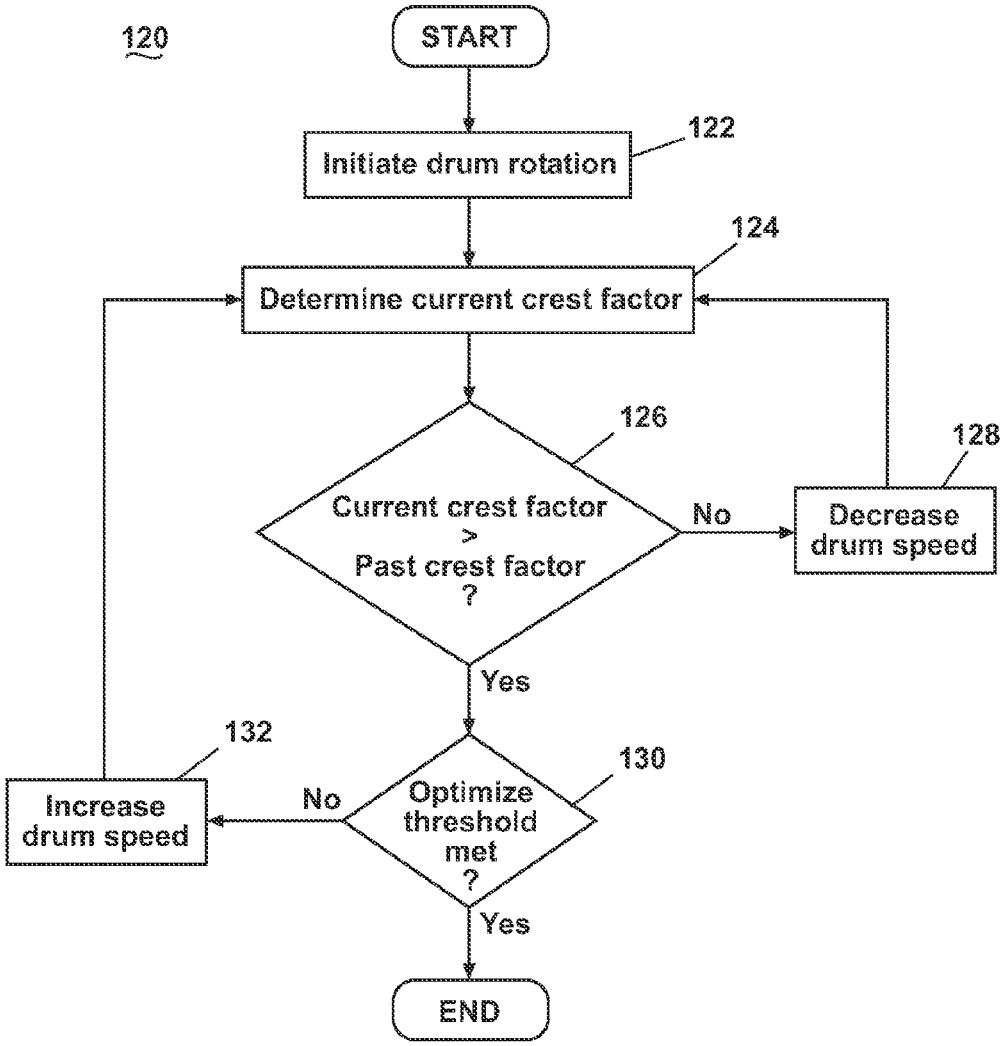
FIG. 8 is a flow chart illustrating one embodiment of a method according to the invention for optimizing the rotational speed of a drum of a washing machine.

FIG. 8 provides a flow chart of an embodiment of a method 120 that employs the above theory for optimizing rotational speed of the drum 18. The sequence of steps depicted is for illustrative purposes only and is not meant to limit the method 120 in any way as it is understood that the steps may proceed in a different logical order, additional or intervening steps may be included, or described steps may be divided into multiple steps, without detracting from the invention. The method 20 may be incorporated into a treating cycle of the washing machine 10, such as during a specific treating phase, for example a wash phase or a tumble wash phase, or may be performed independently from a treating cycle. It is assumed that a load of one or more articles has been placed within the drum 18 prior to commencement of the method 120.

The method 120 may begin with at 122 with initiating rotation of the drum 18. The initial rotational speed may be one suitable to induce tumbling of the load. An exemplary initial speed is 25 RPM. Rotating of the drum 18 may occur subsequent to or simultaneously with the wetting of the load by the liquid supply and recirculation system (not shown). In the washing machine 10 of FIG. 2, the motor 26 may drive the rotation of the drum 18.

According to one embodiment, the motor 26 rotates the drum 18 at the initial speed at a steady state for at least a portion of 122. For example, the drum 18 may rotate according to a constant speed setpoint, wherein the motor 26 is controlled to rotate the drum 18 according to a constant speed while the actual speed of the drum 18 fluctuates about the constant speed setpoint due to the rotation of the load in the drum 18 and imbalance in the load.

At 124, the current crest factor is determined from the waveform of the motor torque signature for the motor 26 operating to rotate the drum 18 at the initial speed.

At 126, the current crest factor is compared to a past crest factor. The past crest factor is the crest factor determined prior to the current crest factor, or is the previous current crest factor determined in the previous cycle though the method 120. In the first cycle through the method 120, the past crest factor is equal to zero.

If it is determined that the current crest factor is not greater than the past crest factor, the method 120 moves on to 128, in which the rotational speed of the drum 18 is decreased. The method 120 then returns to 124.

If it is determined that the current crest factor is greater than the past crest factor, the method moves on to 130 to determine if the rotational speed has been optimized. The rotational speed is considered to be optimized when the crest factor is maximized because this means that the mechanical energy due to falling action being imparted to the articles is also maximized. If it is determined that the rotational speed has not been optimized, the method 120 moves on to 132, and the rotational speed is increased.

If there is no past crest factor, i.e. past crest factor=0, as the case would be the first time the current crest factor is determined at 124, the method 120 will cycle through 130 and 132 to return to 124.

At 128 or 132, the rotational speed may be changed (i.e. increased or decreased) in predetermined increments. A preset scheme for increasing/decreasing the rotational speed may be programmed into the controller 70. For example, the rotational speed may be changed in smaller increments each time the method 120 cycles through 128 or 132.

The maximum crest factor can be determined by cycling through the method 120 until the a maximum crest factor is reached, or by cycling through the method 120 a preset number of times, i.e. a present number of drum rotational speed changes, that is estimated to reach the maximum crest factor within a certain degree of accuracy, for example ±5%. The estimation of the number of times the method must be cycled through to reach the maximum crest factor within a certain degree of accuracy may be predetermined based on empirical testing.

The rotational speed associated with the maximum crest factor may be used to control the rotational speed of the drum as desired, which may be considered the "optimum" for that particular treating cycle or treating cycle phase. In most cases, the actual rotational speed will be set to the rotational speed corresponding to the maximum crest factor to obtain the most mechanical energy imparted to the system because, all things being considered, horizontal axis machines input relatively small amounts of mechanical energy, even at their maximum. If the rotational speed has been optimized, the method 120 may end, or the method may return to 124. If the later is the case, at least 128 and 130 may be periodically run during the treating cycle to make sure rotational speed remains optimized.

One or more of the methods 90, 110, 120 discloses herein may be performed for or during a single treating cycle. For example, methods 90 and 120 could be combined such that the crest factor determination could be used to both determine when to terminate a portion of the treating cycle, as outlined in method 90, and to optimize rotational speed of the drum, as outlined in method 120. These two methods 90, 120 may easily work in together since one way of determining the cumulative value indicative of cumulative mechanism energy due to falling action, as required at 94 of method 90, is by determining crest factor, as done at 124 of method 120.

The embodiments of the method function to determine an optimum rotational speed that maximizes the mechanical agitation of the load. This can provide better article care and reduce wear on the articles since the exposure of the load to movement, heat, and treating chemistry is limited to the amount of time needed for optimum cleaning. Furthermore, the washing machine 10 may be more energy efficient since rotational speed is optimized.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a rotatable drum defining a chamber for receiving a load of laundry to be treated according to a treating cycle, the method comprising:

determining a cumulative value indicative of the cumulative mechanical energy due to the falling action of the laundry for at least a portion of the treating cycle by determining a crest factor of a motor torque waveform for a motor rotating the drum to indicate falling action of the laundry, and if falling action is indicated, determining an area beneath the motor torque waveform for a motor rotating the drum and summing the area over time;

comparing the determined cumulative value with a predetermined threshold value of mechanical energy to be imparted to the laundry during the treating cycle as a function of at least one of a laundry type and a load size; and terminating at least a portion of the treating cycle based on the comparison of the cumulative value with the predetermined threshold value.

2. The method of claim 1 wherein the laundry treating appliance is one of a clothes washer, a clothes dryer, and a combination washer/dryer.

3. The method of claim 1 wherein the threshold value is automatically determined for the load of laundry in the chamber.

4. The method of claim 1 wherein determining the cumulative value indicative of the mechanical energy due to the falling action of the laundry occurs during a treating phase of the treating cycle.

5. The method of claim 4 wherein the treating phase comprises a tumble wash phase.

6. The method of claim 1 wherein the laundry type comprises a fabric material of the load of laundry.

7. The method of claim 1 wherein the load size comprises at least one of a quantitative load size and a qualitative load size.

8. The method of claim 7 wherein the quantitative load size comprises at least one of a mass, a volume, a surface area and a number of articles of the load of laundry.

9. The method of claim 1, further comprising setting an operating rotational speed of the drum based on the cumulative value.

10. The method of claim 9 wherein the operating rotational speed is based on a rotational speed at which a maximum mechanical energy is imparted to the laundry load.

11. The method of claim 1 wherein terminating at least a portion of the treating cycle comprises at least one of terminating a treating phase of the treating cycle and terminating the treating cycle.

12. The method of claim 11 wherein terminating a treating phase of the treating cycle comprises terminating a tumble wash phase of the treating cycle.

13. The method of claim 1 wherein terminating at least a portion of the treating cycle comprises at comprises setting at least one of the duration of a treating phase of the treating cycle and the duration of the treating cycle.

14. The method of claim 1 wherein terminating at least a portion of the treating cycle occurs when the cumulative value has a predetermined relationship with the threshold value.

15. The method of claim 14 wherein terminating at least a portion of the treating cycle occurs when the cumulative value is equal to or greater than the threshold value.

16. A method of operating a laundry treating appliance having a rotatable drum defining a chamber for receiving a load of laundry to be treated according to a treating cycle, the method comprising:

setting a maximum rate of mechanical energy to be transmitted to laundry by falling action;

determining a maximum mechanical enemy rotational speed of the drum at which mechanical energy due to falling action is transmitted to laundry at the set maximum rate by one of increasing and decreasing a rotational speed of the drum until a crest factor of a motor torque waveform for a motor rotating the drum is maximized; and rotating the drum based on the maximum mechanical enemy rotational speed.

17. The method of claim 16 wherein the laundry treating appliance is one of a clothes washer, a clothes dryer, and a combination washer/dryer.

18. The method of claim 16 wherein the maximum rate of mechanical energy to be transmitted to laundry by falling action is a function of at least one of a laundry type and a load size.

19. The method of claim 18 wherein the laundry type is a fabric material of the load of laundry.

20. The method of claim 18 wherein the load size is one of quantitative load size and qualitative load size.

21. The method of claim 20 wherein the quantitative load size is one of a mass, a volume, a surface area and a number of articles of the load of laundry.

22. The method of claim 16 wherein the maximum rate of mechanical energy to be transmitted to laundry by falling action is automatically determined for the load of laundry in the chamber.

23. The method of claim 16 wherein the setting a maximum rate of mechanical energy to be transmitted to laundry by falling action occurs as part of the treating cycle.

24. The method of claim 16 wherein the rotating the drum based on the maximum mechanical energy rotational speed occurs during a treating phase of the treating cycle.

25. The method of claim 24 wherein the treating phase comprises a tumble wash phase.

26. A method of operating a laundry treating appliance having a rotatable drum defining a chamber for receiving a load of laundry to be treated according to a treating cycle, the method comprising:

determining a value indicative of a mechanical energy rate due to the falling action of the laundry, wherein the value is a current crest factor of a motor torque waveform for a motor rotating the drum that is compared with a past crest factor of the motor torque waveform for a motor rotating the drum; and setting an operating rotational speed of the drum based on the determined value.

27. The method of claim 26 wherein the laundry treating appliance is one of a clothes washer, a clothes dryer, and a combination washer/dryer.

28. The method of claim 26 wherein the value is automatically determined for the load of laundry in the chamber.

29. The method of claim 26 wherein determining the value occurs as part of the treating cycle.

30. The method of claim 29 wherein determining the value occurs during a treating phase of the treating cycle.

31. The method of claim 30 wherein the treating phase comprises a tumble wash phase.

32. The method of claim 26 further comprising at least one of terminating a treating phase of the treating cycle, setting a duration of a treating phase of the treating cycle, terminating the treating cycle, or setting a duration of the treating cycle.

* * * * *